United States Patent [19]

Savalle, Jr.

[11] 4,232,320

[45] Nov. 4, 1980

[54] MOUNT FOR EARTH STATION ANTENNA

[75] Inventor: Rene Savalle, Jr., Tinley Park, Ill.

[73] Assignee: Andrew Corporation, Orland Park, Ill.

[21] Appl. No.: 898,638

[22] Filed: Apr. 21, 1978

[51] Int. Cl.[2] ..... H01Q 3/08

[52] U.S. Cl. ..... 343/765; 343/912; 343/882

[58] Field of Search ..... 343/880–882, 343/757, 758, 765, 766, 912, 915

[56] References Cited

U.S. PATENT DOCUMENTS

| | | | |
|---|---|---|---|
| 3,553,732 | 1/1971 | Glynn | 343/915 |
| 3,945,015 | 3/1976 | Gueguen | 343/766 |

*Primary Examiner*—David K. Moore

*Attorney, Agent, or Firm*—Leydig, Voit, Osann, Mayer & Holt, Ltd.

[57] ABSTRACT

A mount for an earth station antenna includes an hour angle beam suppoting the antenna for pivotal movement of the antenna about an hour angle axis determined by the position of the hour angle beam. An adjustable azimuth strut is connected to the antenna for pivoting the antenna about the hour angle axis. Two pairs of struts pivotally support the hour angle beam at spaced pivot points to permit adjustment of the hour angle axis so that the antenna can be pointed at a satellite. The lower ends of the two pairs of struts are pivotally connected to a foundation on horizontally spaced axes with the lower ends of the pair of struts connected to the lower pivot point on the hour angle beam being spaced farther away from the lower end of the beam than the lower ends of the other pair of struts, so that pivotal movement of the hour angle beam pivots the upper and lower ends of the beam along different arcs. An adjustable elevation strut pivots the two pairs of main support struts about their pivotal connections to the foundation to adjust the vertical positions of the upper ends of the struts to effect pivotal movement of the hour angle beam.

8 Claims, 4 Drawing Figures

MOUNT FOR EARTH STATION ANTENNA

DESCRIPTION OF THE INVENTION

The present invention relates generally to antenna mounts and, more particularly, to mounts for earth station antennas.

It is a primary object of the present invention to provide a mount for earth station antennas which greatly facilitates field installation and adjustment of the antenna and its mount.

A more particular object of this invention is to provide such an improved mount which permits the antenna and its mount to be erected more quickly than previous mounts, and with fewer adjustments and reduced likelihood of bending or warping the mount. In this connection, a related object of the invention is to provide such an improved mount which minimizes the cost of the mount.

A further object of the invention is to provide such an improved mount which eliminates most of the universal joints required in previous mounts.

A still further object of the invention is to provide such an improved mount which achieves all the foregoing objectives and yet can be adjusted over a wide range of hour angles, declination angles and inclination angles for the hour angle axis for virtually any desired latitude location.

Yet another object of the invention is to provide such an improved mount which can be efficiently manufactured and erected.

Still another object of the invention is to provide such an improved mount that maintains the antenna relatively close to the earth's surface over a wide range of elevation angles, thereby minimizing wind loads at the base of the mount and stresses within the mount. A related object is to provide such a mount which minimizes the strength requirements and cost of the foundation for the mount.

Other objects and advantages of the invention will be apparent from the following detailed description and the accompanying drawings, in which.

While the invention will be described in connection with certain preferred embodiments, it will be understood that it is not intended to limit the invention to these particular embodiments. On the contrary, it is intended to cover all alternatives, modifications and equivalents included within the spirit and scope of the invention as defined by the appended claims.

Figure 1:
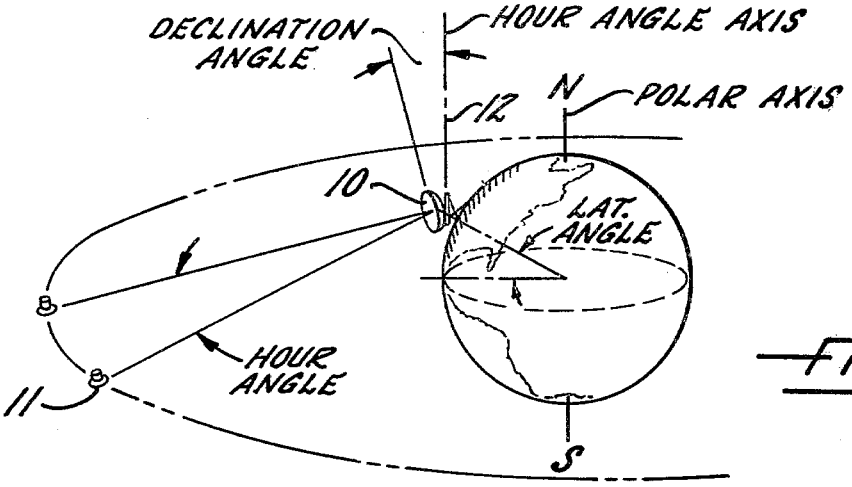
FIG. 1 is a schematic perspective diagram of a communication satellite orbiting the earth in the equatorial plane with an earth station antenna mounted on the northern hemisphere of the earth for communicating with the satellite.

Turning now to the drawings and referring first to FIG. 1, a parabolic antenna 10 is shown mounted at a location on the northern hemisphere of the earth for communication with a communication satellite 11 orbiting in the equatorial plane of the earth. The satellite 11 travels in a geostationary orbit, which means that it rotates around the polar axis of the earth at the same rate at which the earth rotates about its polar axis, so that the satellite remains in a stationary position relative to any given point on the earth's surface.

To permit the antenna 10 to be precisely aimed toward the satellite 11, the antenna is mounted for pivotal movement about an hour angle axis 12 which is parallel to the polar axis of the earth. In this connection, it should be noted that this hour angle adjustability of the antenna is useful not only in aligning the antenna with the satellite when the antenna is first installed, but also for subsequent adjustment of the antenna to align it with different satellites; the life of an earth station antenna is considerably longer than that of a satellite, and thus any given antenna will normally communicate with a number of different satellites during the lifetime of the antenna.

In addition to the hour angle adjustment, the antenna 10 is also mounted for pivoting movement about a declination axis which is perpendicular to the hour angle axis. This adjustment is referred to as the declination angle and permits an antenna mounted at any latitude to "look" at a satellite orbiting in the equatorial plane. As can be seen in FIG. 1, after the declination angle has been properly adjusted, movement of the antenna about its hour angle allows the antenna to be precisely pointed at a geostationary satellite. Thus, it will be appreciated that by adjusting the declination angle and/or the hour angle, a given antenna can be aimed at satellites having a wide range of different locations within the equatorial plane.

Figure 4:
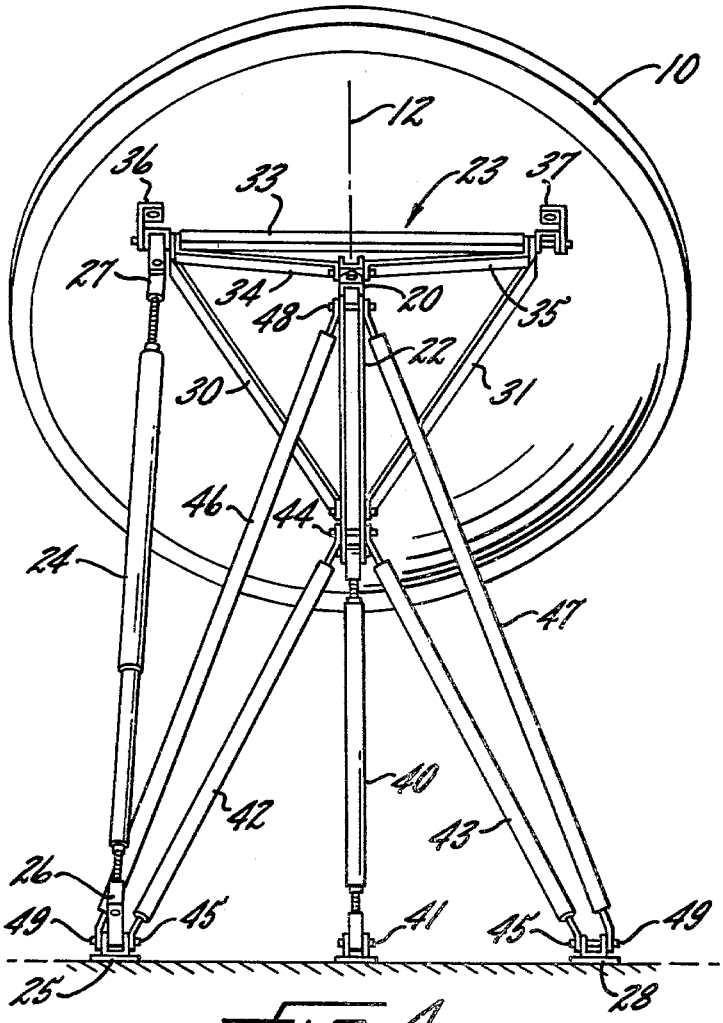
FIG. 4 is a rear elevation taken generally along line 4—4 in FIG. 2.
Figure 3:
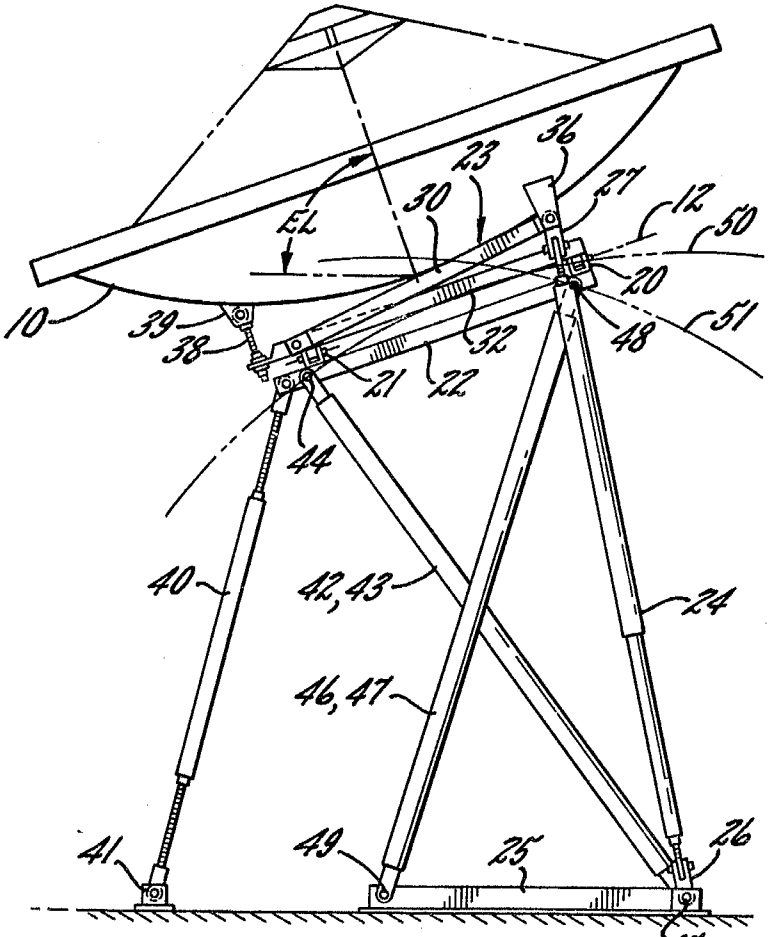
FIG. 3 is a side elevation of the same structure shown in FIG. 2 but with the hour angle axis set at an angle of 70° (for a 20° latitude location)
Figure 2:
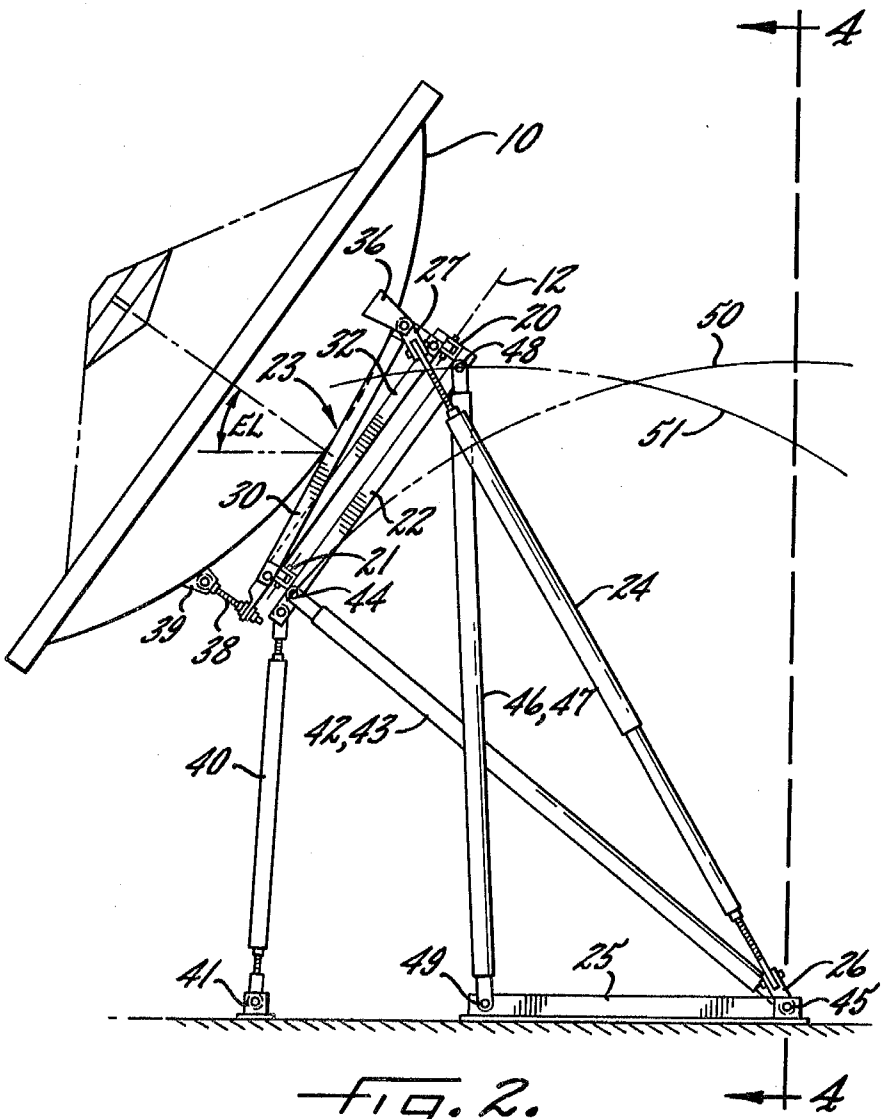
FIG. 2 is a side elevation of an earth station antenna on a polar mount embodying the invention and with the hour angle axis set at an angle of 35° (for a 55° latitude location)

Turning next to FIGS. 2–4, the hour angle axis of the exemplary polar mount is defined by a pair of pivotal connections 20 and 21 between an hour angle beam 22 and an antenna frame 23. Thus, the antenna 10 and its supporting frame 23 can be pivoted about the axis 12 defined by the pivotal connections 20 and 21 in response to elongating or contracting movement of an azimuth strut 24 which is connected at its upper end to one corner of the frame 23. The lower end of the azimuth strut 24 is connected to a foundation pad 25 through a universal joint 26, and a second universal joint 27 connects the upper end of the azimuth strut 24 to the antenna frame 23. These two universal joints 26 and 27 are the only universal joints required in the illustrative polar mount, and are required to permit the azimuth strut 24 to swing laterally in response to pivoting movement of the antenna about the hour angle axis 12, while also permitting the strut 24 to pivot vertically during changes in the elevation angle of the hour angle axis (e.g., from the position shown in FIG. 2 to the position shown in FIG. 3).

It should be noted that the upper and/or lower end of the adjustable azimuth strut 24 can be connected to the opposite side of the polar mount if the degree of hour angle adjustment is such that one of the other members of the polar mount interferes with the strut 24. For example, the lower end of the strut 24 can be connected to a foundation pad 28 (FIG. 4) on the opposite side of the polar mount, and/or the upper end of the azimuth strut 24 can be connected to the opposite corner of the support frame 23 if desired.

The antenna support frame 23 comprises a generally triangular arrangement of structural members which are shown most clearly in FIG. 4. Thus, a pair of side beams 30 and 31 are secured at their lower ends to a center beam 32 and extend upwardly and outwardly therefrom to the opposite ends of a cross beam 33 which defines the declination axis. The upper end of the center beam 32 is connected to opposite ends of the cross beam 33 by means of beams 34 and 35. To permit pivotal movement of the antenna 10 and the cross beam about the declination axis, opposite ends of the cross beam are secured to the antenna by means of a pair of brackets 36 and 37, and the connecting beams 30, 31 and 34, 35 are all journaled on the ends of the cross beam 33. Adjustment of the declination angle is effected by means of a threaded stud 38 (FIGS. 2 and 3) which connects the bottom end of the center beam 32 to a bracket 39 on the antenna 10.

As will be apparent from the general description of a polar mount given above in connection with FIG. 1, a fundamental requisite of a polar mount is that the hour angle axis be positioned parallel to the polar axis of the earth and perpendicular to the equatorial plane of the earth. This requires that the hour angle axis be positioned at different angles of inclination relative to the earth's surface, depending upon the particular latitude of the antenna location on the earth's surface. Consequently, it is necessary to provide means for adjusting the angle of inclination of the hour beam 22, i.e., the angle of the beam relative to the surface on which the foundation pads 25 and 26 are anchored. In the particular embodiment illustrated, this adjustment is effected by an adjustable elevation strut 40 which is pivotally connected at its lower end to a foundation pad 41 and at its upper end to the bottom of the hour angle beams 22. Both ends of the elevation strut 40 are provided with elongated threaded studs which can be threaded in and out of the main body portion of the strut 40 to expand or contract the length of the strut 40, thereby adjusting the inclination angle of the beam 22 so that the hour angle axis 12 can be positioned parallel to the polar axis of the earth.

In accordance with one important aspect of the present invention, first and second pairs of struts pivotally support the hour angle beam at spaced pivot points to permit adjustment of the inclination angle of the hour angle axis by the elevation strut, the lower ends of the first and second pairs of struts being pivotally connected to the foundation on horizontally spaced axes with the lower ends of the pair of struts connected to the lower pivot point on the hour angle beam being spaced farther away from the lower end of the beam than the lower ends of the other pair of struts, so that pivotal movement of the hour angle beam pivots the upper and lower ends of the beam along different arcs. Thus, in the illustrative embodiment, a pair of lower struts 42 and 43 have their upper ends pivoted to the lower end of the hour angle beams 22 on axis 44 and their lower ends pivoted to the rear ends of the foundation pads 25 and 28, respectively, on axis 45. An upper pair of struts 46 and 47 have their upper ends pivoted to the upper end of the hour angle beam 22 on axis 48 and their lower ends pivoted to the forward end of the foundation pads 25 and 28, respectively, on axis 49.

With the structure provided by this invention, the angle of the hour angle axis 12 can be adjusted for any given latitude by simply changing the length of the single elevation strut 40. As the length of the strut 40 is changed, the two pairs of struts 42, 43 and 46, 47 that support opposite ends of the hour angle beam 22 pivot about their fixed axes 45 and 49, respectively, thereby changing the inclination angle of the beam 22 and 12. During this pivotal movement of the struts 42, 43 and 46, 47, the axes 44 and 48 at the upper ends of these struts move along arcs 50 and 51 centered on the fixed axes 45 and 49, respectively, and having radii defined by the lengths of the strut pairs 42, 43 and 46, 47, respectively. It will be appreciated that the lengths of the struts 42, 43 and 46, 47 remain constant at all times during this pivotal movement, and the only struts that change length are the elevation strut 40 and the azimuth strut 24. Moreover, the struts 42, 43 and 46, 47 pivot in only a single plane, so there is no need for a universal joint at either end of any of these four struts.

FIGS. 2 and 3 illustrate the antenna mount with the hour angle axis at two different angles (35° and 70°) which represent the two extreme positions for antenna installations within the northern and southern extremities of the continental United States. As can be seen most clearly in these figures, elongation of the elevation strut 40 causes the lower axis 44 on the hour angle beam 22 and thus the lower end of the beam 22, to move upwardly in elevation at a relatively rapid rate, due to the fact that the axis 44 is located on a relatively steep segment of the arc 50. At the same time, the upper axis 48 on the beam 22 and thus the upper end of the beam itself, moves laterally along the arc 51 with very little change in elevation, due to the fact that the axis 46 is located on a relatively horizontal segment of the arc 51. The net result is a relatively fast rate of change in the angle of the hour angle axis 12 in response to changes in the length of the elevation strut 40.

In polar mounts used in the prior art, the two pairs of supporting struts corresponding to the struts 42, 43 and 46, 47 have generally been pivoted on a common single axis on the foundation pads. In these prior art structures, changes in angle of inclination of the hour angle axis are generally effected by changing the length of the uppermost pair of the main support struts for a coarse adjustment, with the elevation strut being used for a fine adjustment. This is a difficult operation when a large antenna is being erected with a crane in the field, because the two main support struts must be adjusted simultaneously to avoid bending or warping other portions of the mount. Furthermore, universal joints are required at both ends of the adjustable main struts because they tilt both laterally and vertically when they are adjusted in length. With the structure of the present invention, however, only a single adjustment, namely the length of the elevation strut 40, is required to effect any desired change in the angle of inclination of the hour angle axis. (The azimuth strut 24 can be connected after the position at the hour angle axis has been set, with the length of the azimuth strut determining the hour angle position). Moreover, no universal joints are required for any of the main support struts 42, 43 and 46, 47.

Since the lower ends of the two pairs of main supporting struts 42, 43 and 46, 47 are pivoted on two different horizontal axes 45 and 49 which are spaced a substantial distance apart from each other, a relatively short range of length adjustments in the elevation strut 40 can move the hour beam 22 through a relatively wide range of angles, and without significantly changing the elevation of the uppermost edge of the antenna dish. Because the upper and lower ends of the hour angle beam 22 are moved along different arcs, any change in the length of the elevation strut 40 effects a corresponding change in the inclination angle of the hour angle axis at a rapid rate, and without any significant change in the elevation of the upper end of the beam 22 above ground level. This is important because any increase in the total height of the antenna installation increases wind loads at the base of the mount, as well as stresses within the mount, and requires a stronger and more costly foundation to support the antenna and its mount.

It should be noted that the rate at which the inclination angle of the hour angle axis changes with adjustments in the length of the elevation strut 40 can be increased even further by orienting the struts 46, 47 so that the axis 48 drops in elevation whenever the axis 44 rises, and vice versa. For example, the fixed axis 49 at the lower ends of the struts 46, 47 could be moved to the left as viewed in FIG. 2, and/or the movable axis 48 of the upper ends of these struts could be moved to the right, so that the axis 48 would traverse a more steeply sloped segment of the arc 51. This would cause the upper axis 48 to ride downe the arc 51 whenever the lower axis 44 rides up the arc 50, and vice versa, thereby producing an extremely rapid rate of change in the angle of the hour angle axis in response to any change in the length of the elevation strut 40.

Although the invention has been described above with specific reference to a polar mount, it will be understood that the invention is also applicable to other types of mounts such as the "azimuth-over-elevation" mount. A polar mount is one in which the hour angle axis is oriented parallel to the earth's axis of rotation, and a separate declination axis of adjustment is required to allow the antenna to be pointed at an orbiting satellite from a different latitude. In an azimuth-over-elevation mount, the adjustments that are effected around the declination axis and the hour angle axis in the polar mount are combined into one adjustment by eliminating the declination adjustment and adjusting the length of the elevation strut so that the hour angle axis is perpendicular to a line extending from the earth station antenna to the satellite. This is a somewhat simpler mount than a polar mount, but it generally produces a higher silhouette and greater foundation stresses, and makes it more difficult to point the antenna at a different satellite.

As can be seen from the foregoing detailed description, this invention provides a mount for earth station antennas which greatly facilitates field installation and adjustment of the antenna and its mount. This improved mount permits the antenna and its mount to be erected more quickly than previous mounts, and with fewer adjustments and reduced likelihood of bending or warping the mount. Because of the unique arrangement of the main supporting struts for the hour angle beam, most of the universal joints required in previous mounts are also eliminated. Furthermore, the antenna is maintained relatively close to the earth's surface over a wide range of elevation angles, thereby minimizing wind loads at the base of the mount and stresses within the mount, and also minimizing the strength requirements and cost of the foundation for the mount. This improved mount can also be efficiently manufactured and erected, with the end result being a substantial reduction in the cost of an antenna installation utilizing this mount. As with previous mounts, an antenna supported by the mount of this invention can still be adjusted over a wide range of hour angles, declination angles and inclination angles for the hour angle axis for virtually any desired latitude location.

I claim as my invention:

1. A mount for an earth station antenna, said mount comprising an hour angle beam supporting the antenna for pivotal movement of the antenna about an hour angle axis determined by the position of the hour angle beam and an adjustable azimuth strut connected to the antenna for pivoting the antenna about said hour angle axis, a foundation on the earth's surface for supporting the antenna, first and second pairs of struts pivotally supporting the hour angle beam at pivot points spaced from each other in the direction of the hour angle axis to permit adjustment of the hour angle axis so that the antenna can be pointed at a satellite, the lower ends of said first and second pairs of struts being pivotally connected to said foundation on horizontally spaced axes with the lower ends of the pair of struts connected to the lower pivot point on the hour angle beam being spaced farther away from the lower end of the hour angle beam than the lower ends of the other pair of struts, so that pivotal movement of the hour angle beam pivots the upper and lower ends of the hour angle beam along different arcs, and elevation adjusting means connected to the hour angle beam for adjusting said hour angle axis by pivoting the hour angle beam on said struts.

2. A mount as set forth in claim 1 wherein said mount is a polar mount having the hour angle axis parallel to the polar axis of the earth, and which includes declination angle adjusting means connected to the antenna for pivoting the antenna about a declination angle axis that is perpendicular to the hour angle axis.

3. A mount as set forth in claim 1 wherein said mount is an azimuth-over-elevation mount.

4. A mount as set forth in claim 1 wherein said elevation adjusting means comprises an adjustable strut with a lower end pivotally connected to a foundation and an upper end pivotally connected to the lower end of said hour angle beam.

5. A mount as set forth in claim 1 wherein said first and second pairs of struts are all of fixed length.

6. A mount for an earth station antenna, said mount conprising a foundation on the earth's surface for supporting the antenna, first and second pairs of struts pivotally connected to said foundation on horizontally spaced axes at the lower ends of said struts, hour angle adjusting means including means pivotally connecting the upper ends of said first and second struts to said antenna to support the antenna while permitting pivotal movement of the antenna about an hour angle axis determined by the vertical positions of the upper ends of said struts, the pivotal connections of the upper ends of said struts being spaced from each other in the direction of the hour angle axis, and means for pivoting the antenna about said hour angle axis, and elevation adjusting means for pivoting said struts about their pivotal connections to said foundation to adjust the vertical positions of the upper ends of said struts so that the antenna can be pointed at a satellite.

7. A mount for an earth station antenna, said mount comprising an hour angle beam supporting the antenna for pivotal movement of the antenna about an hour angle axis determined by the position of the hour angle beam, and an adjustable azimuthstrut connected to the antenna for pivoting the antenna about said hour angle axis, a foundation on the earth's surface for supporting the antenna, first and second pairs of struts pivotally supporting the hour angle beam at pivot points spaced from each other in the direction of the hour angle axis to permit adjustment of the hour angle axis so that the antenna can be pointed at a satellite, the lower ends of said first and second pairs of struts being pivotally connected to said foundation on horizontally spaced axes with the two pairs of struts crossing each other between said hour angle beam and said foundation, and elevation adjusting means connected to the hour angle beam for adjusting said hour angle axis by pivoting the hour angle beam on said struts.

8. A mount for an earth station antenna, said mount comprising a foundation on the earth's surface for supporting the antenna, first and second pairs of strut means pivotally connected to said foundation on horizontally spaced axes at the lower ends of said struts, hour angle adjusting means including means pivotally connecting the upper ends of said first and second strut means to said antenna to support the antenna while permitting pivotal movement of the antenna about an hour angle axis determined by the vertical positions of the upper ends of said strut means, the pivotal connections of the upper ends of said struts being spaced from each other in the direction of the hour angle axis, and means for pivoting the antenna about said hour angle axis, and elevation adjusting means for pivoting said strut means about their pivotal connections to said foundation to adjust the vertical positions of the upper ends of said strut means with the lower end of the strut means having the lower upper end being spaced farther away from the lower edge of the antenna than the lower end of the other strut means so that pivotal movement of said first and second strut means tilts the hour angle axis at a fast rate.

* * * * *